US006376446B1

(12) United States Patent
Smadi et al.

(10) Patent No.: US 6,376,446 B1
(45) Date of Patent: Apr. 23, 2002

(54) LIQUID DETERGENT COMPOSITION

(75) Inventors: Raeda Smadi; George A. Smith, both of Austin, TX (US); Suk H. Cho, Idaho Falls, ID (US)

(73) Assignee: Melaleuca, Inc, Idaho Falls, ID (US)

( * ) Notice: Subject to any disclaimer, the term of this patent is extended or adjusted under 35 U.S.C. 154(b) by 0 days.

(21) Appl. No.: 09/481,425

(22) Filed: Jan. 12, 2000

Related U.S. Application Data

(60) Provisional application No. 60/115,870, filed on Jan. 13, 1999.

(51) Int. Cl.[7] ..... C11D 1/83; C11D 5/30; C11D 3/42

(52) U.S. Cl. ..... 510/325; 510/336; 510/337; 510/338; 510/341; 510/342; 510/350; 510/351; 510/356; 510/357; 510/361; 510/499

(58) Field of Search ..... 510/325, 336, 510/337, 338, 341, 342, 350, 351, 356, 357, 361, 499

(56) References Cited

U.S. PATENT DOCUMENTS

| | | | | |
|---|---|---|---|---|
| 3,819,528 | A | | 6/1974 | Berry |
| 3,860,536 | A | | 1/1975 | Landwerlen et al. |
| 3,869,399 | A | | 3/1975 | Collins |
| 3,870,647 | A | | 3/1975 | Travers |
| 3,951,960 | A | | 4/1976 | Heath et al. |
| 3,953,351 | A | | 4/1976 | Keller |
| 3,980,713 | A | | 9/1976 | Matsunaga et al. |
| 3,993,659 | A | | 11/1976 | Meyer |
| 4,021,377 | A | | 5/1977 | Borchert et al. |
| 4,079,078 | A | | 3/1978 | Collins |
| 4,178,262 | A | | 12/1979 | Compton et al. |
| 4,201,686 | A | | 5/1980 | Augustijn |
| 4,268,262 | A | | 5/1981 | Bechstedt |
| 4,285,841 | A | | 8/1981 | Barrat et al. |
| 4,298,290 | A | | 11/1981 | Barnes et al. |
| 4,318,818 | A | | 3/1982 | Letton et al. |
| 4,321,167 | A | | 3/1982 | Schmolka |
| 4,338,212 | A | | 7/1982 | Wegener et al. |
| 4,375,416 | A | | 3/1983 | Crisp et al. |
| 4,446,042 | A | | 5/1984 | Leslie |
| 4,515,705 | A | | 5/1985 | Moeddel |
| 4,530,780 | A | | 7/1985 | van de Pas et al. |
| 4,537,706 | A | | 8/1985 | Severson, Jr. |
| 4,537,707 | A | | 8/1985 | Severson, Jr. |
| 4,550,862 | A | | 11/1985 | Barker et al. |
| 4,561,998 | A | | 12/1985 | Wertz et al. |
| 4,597,898 | A | | 7/1986 | Vander Meer |
| 4,608,189 | A | | 8/1986 | Koch et al. |
| 4,618,446 | A | | 10/1986 | Haslop et al. |
| 4,668,423 | A | | 5/1987 | Drozd et al. |
| 4,675,124 | A | | 6/1987 | Seiter et al. |
| 4,743,395 | A | * | 5/1988 | Leifheit ..... 252/546 |
| 4,746,461 | A | | 5/1988 | Zielske |
| 4,767,562 | A | | 8/1988 | Fry |
| 4,793,943 | A | | 12/1988 | Haslop et al. |
| 4,861,502 | A | | 8/1989 | Caswell |
| 4,891,160 | A | | 1/1990 | Vander Meer |
| 4,965,014 | A | | 10/1990 | Jeschke et al. |
| 4,968,451 | A | | 11/1990 | Scheibel et al. |
| 5,021,195 | A | | 6/1991 | Machin et al. |
| 5,035,826 | A | | 7/1991 | Durbut et al. |
| 5,147,576 | A | | 9/1992 | Montague et al. |
| 5,194,639 | A | | 3/1993 | Connor et al. |
| 5,205,957 | A | | 4/1993 | Van de Pas |
| 5,269,960 | A | | 12/1993 | Gray et al. |
| 5,288,431 | A | | 2/1994 | Huber et al. |
| 5,290,475 | A | * | 3/1994 | Wixon ..... 252/174.23 |
| 5,292,448 | A | * | 3/1994 | Klugkist ..... 252/174.12 |
| 5,458,809 | A | | 10/1995 | Fredj et al. |
| 5,458,810 | A | | 10/1995 | Fredj et al. |
| 5,460,752 | A | | 10/1995 | Fredj et al. |
| 5,460,753 | A | | 10/1995 | Holdar |
| 5,466,802 | A | | 11/1995 | Panandiker et al. |
| 5,470,505 | A | | 11/1995 | Smith et al. |
| 5,565,145 | A | | 10/1996 | Watson et al. |
| 5,589,448 | A | | 12/1996 | Koerner et al. |
| 5,719,118 | A | | 2/1998 | Crutcher et al. |
| 5,789,364 | A | | 8/1998 | Sells et al. |
| 6,013,616 | A | * | 1/2000 | Fabry et al. ..... 510/472 |
| 6,017,874 | A | * | 1/2000 | Lappas et al. ..... 510/504 |

* cited by examiner

*Primary Examiner*—Gregory Delcotto
(74) *Attorney, Agent, or Firm*—Fish & Richardson P.C., P. A.

(57) ABSTRACT

Liquid detergent compositions are described. The liquid detergent can contain defined mixtures of anionic, nonionic and cationic surfactants. The surfactants can be present at concentrations ranging from about at least 15% to about 60%. A useful ingredient in the detergent includes an alkylamine ethoxylate. This ethoxylate should have at least about 5 moles of ethoxylate per mole of the surfactant. Additional ingredients in the detergent include alkylamines and polyalkylene glycols, which facilitate achieving stable, pourable and pumpable liquid detergents that are highly concentrated. Other ingredients may also be included in the liquid detergent.

40 Claims, No Drawings

LIQUID DETERGENT COMPOSITION

STATEMENT OF PRIORITY

This application claims priority from, and hereby incorporates by reference, U.S. Provisional Application Ser. No. 60/115,870, filed Jan. 13, 1999.

FIELD OF THE INVENTION

This invention relates to detergent compositions. More specifically, the invention relates to liquid detergent compositions having defined compositions.

BACKGROUND OF THE INVENTION

Liquid detergents enjoy wide consumer acceptance for a variety of uses. Liquid detergents are preferred over dry granular detergents because liquid detergents can be used without having to pre-dissolve the detergent. Also, liquid detergents can be directly applied to stains and fabrics. Recently, there has been a shift in emphasis from providing regular strength detergent formulations to concentrated detergent formulations. Liquid concentrates can reduce manufacturing costs and require less packaging. Consumers have reacted favorably to the concentrated formulations as long as the products retain their cleaning efficiency.

The surfactant (nonionic and anionic) concentrations in most commercially available concentrates range from about 15% to about 26%. Typically, blends of nonionic and anionic surfactants are used to enable the detergents to remove a variety of stain types. Additional ingredients such as anti-redeposition, builders, enzymes, dye-transferring polymers and foam stabilizers are added to improve detergent performance. Unfortunately, these concentrated detergents are more difficult to process and can result in detergents that undergo phase separation and/or tend to form a gel.

There are unbuilt liquid laundry detergents having surfactant concentrations higher than 30%. These detergents typically contain nonionic surfactants. Unbuilt detergents, however, are generally unsuitable for hard water areas and have enjoyed limited success. Further, unbuilt liquid detergents also suffer from instability when the surfactant concentrations are increased.

To circumvent the instability of concentrated liquid detergents, some manufacturers suspend builder and/or other functional materials as solids in liquid surfactant micelles or emulsions. It is difficult to prevent sedimentation of the micelles and emulsions. Other solutions have been proposed. It has been suggested that the addition of counter ions such as sodium and potassium may increase detergent stability. Nevertheless, no general theory has arisen that explains why some detergent formulations are stable while others separate or become gel like. Thus, there exists a need for economical concentrated and super-concentrated liquid detergents that remain stable during storage.

SUMMARY OF THE INVENTION

In one aspect, the invention is a liquid detergent composition having one or more surfactants and an alkylamine and/or a polyalkylene glycol wherein the detergent is effective for washing laundry. In other embodiments, the liquid detergent can include one or more of the following constituents.

In one embodiment, a liquid detergent contains anionic surfactant at a concentration from about 5% to about 55% on a weight percentage basis, a nonionic surfactant at a concentration from about 10% to about 55% on a weight percentage basis, an alkylamine ethoxylate at a concentration from about 5% to about 55% on a weight percentage, a polyalkylene glycol at a concentration from about 1% to about 25% on a weight percentage basis, and an effective amount of an alkylamine. The liquid detergent may also leave out either the alkylamine or the polyalkylene glycol but the quality of the detergent may be adversely affected. The pH of the detergent can range from about 6 to about 9. Typically, the molecular weight of said polyalkylene glycol ranges from about 100 to about 5000.

The alkylamine ethoxylate may contain at least about 5 moles of ethoxylate per mole of said alkylamine ethoxylate. The alkylamine may be any short chain alkylamine and can be selected from the group consisting of monoethanolamine, triethanolamine, and diethanolamine.

There are many types of surfactants that can be included in one or more of the embodiments of the liquid detergents that are concentrated or super-concentrated. These detergents can include:

Alkylbenzene sulfonate surfactants having the formula

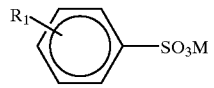

wherein $R_1$ is alkyl group having from 1 to 15 carbon atoms and M is H, alkali metal or alkylamine. $R_1$ may be a linear alkyl group having from about 8 carbons to about 16 carbons. The alkali metal can be selected from the group consisting of sodium, potassium and lithium, and the alkylamine can be selected from the group consisting of monoethanolamine, triethanolamine, and diethanolamine, and anionic surfactants such as alkylether sulfates having the formula:

$$R_1—(OCHR_2CHR_2)_n—SO_4M$$

wherein $R_1$ is an alkyl group having from 10 to 22 carbon atoms, $R_2$ is H, or an alkyl group having from 1 to 4 carbon atoms, n is an integer from 1 to 10, and M is an alkali metal or an alkylamine. An alkylether sulfate that is a $C_{10}$–$C_{18}$ alcohol sulfate with 1–7 moles of ethyleneoxide per mole of alcohol may be used. The alkylether sulfate may be neutralized with alkylamine by about 50% or higher. Any alkylamine such as monoethanolamine, triethanolamine, or diethanolamine will suffice.

Nonionic surfactants may also be added. These surfactants can include alkoxylated alcohols having the formula $$R_1—(OCHR_2CHR_2)_x—OR_3$$

wherein $R_1$ is an alkyl group having from 6 to 22 carbon atoms, $R_2$ is H or an alkyl group having from 1 to 4 carbon atoms, x is integer from 2 to 20, and $R_3$ is H or an alkyl group having from 1 to 4 carbon atoms. The alcohol can contain from 2 to 20 moles of either ethoxylate, propoxylate or a mixture thereof. In one embodiment, the alkoxylated alcohol includes an ethoxylated alcohol having from 8 to 16 carbon atoms, and wherein the alcohol further comprises from about 4 to about 20 moles of ethylene oxide per mole of the alcohol, and less than 4 moles of propylene oxide per mole of the alcohol.

Other nonionic surfactants include alkylphenyl ethoxylates having the formula

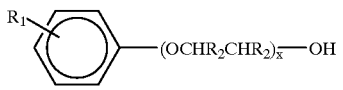

wherein $R_1$ is an alkyl group having from 6 to 16 carbon atoms, $R_2$ is H or an alkyl group having from 1 to 4 carbon atoms, and x is an integer from 1 to 10. The ethoxylate can contain from 1 to 10 moles of either ethoxylate, propoxylate, or a mixture thereof. Alkylphenyl ethoxylate can include an ethoxylated $C_6$ to $C_{16}$ phenylalcohol further containing from about 4 to about 20 moles of ethylene oxide per mole of the ethoxylate, and less than 4 moles of propylene oxide per mole of the ethoxylate. The alkyloxylated surfactant can include an ethoxylated $C_8$ to $C_{16}$ alcohol having from about 4 to about 20 moles of ethylene oxide per mole of alcohol, and less than 4 moles of propylene oxide per mole of alcohol.

Suitable alkylamine ethoxylates can have the formula

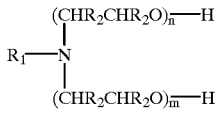

wherein $R_1$ is alkyl group having from 6 to 22 carbon atoms, $R_2$ is H or an alkyl group having from 1 to 4 carbon atoms, and m and n are integers ranging from about 1 to about 20. In certain embodiments, the alkylamine ethoxylate includes an ethoxylated $C_8$ to $C_{16}$ amine having from about 4 to about 26 moles of ethylene oxide per mole of the alkylamine ethoxylate, and less than 4 moles of propylene oxide per mole of the alkylamine ethoxylate.

Polyalkylene glycols used in the liquid detergents can be any polyalkylene glycol including polyethylene glycol and polypropylene glycol. The glycols can be modified versions where, for example, the polyalkylene glycol includes a polyethylene glycol or a polyethlenepropylelene glycol having a molecular weight ranging from about 100 to about 5000.

The polyalkylene glycol can be derived from a mixture of ethyleneoxide and propyleneoxide. In particular, the polyalkylene glycol can have the formula $$H—(OCHR_1CHR_1)_x—OH$$

wherein $R_1$ is H or an alkyl group having from 1 to 4 carbon atoms, and x is ant integer ranging from about 2 to about 100.

In another embodiment, the liquid detergents can include one or more of the following ingredients: 1) an optical brightener at a concentration from about 0.01% to about 1% on a weight percentage basis, 2) a polyacrylate having a molecular weight ranging from about 500 to about 50000, perhaps where the polyacrylate is at a concentration from about 0.01% to about 2% on a weight percentage basis, 3) an organic polycarboxylic acid at a concentration from about 0.01% to about 5% on a weight percentage basis, 4) a chelator at a concentration from about 0.01% to about 5% on a weight percentage basis, 5) an electrolyte at a concentration from about 0.01% to about 5% on a weight percentage basis, and 6) a solvent glycol at a concentration no greater than about 15% on a weight percentage basis, the solvent containing a lower alkanol, glycol, or alkylene.

Solvents can be selected from the group consisting of propanol, ethanol, isopropanol, ethylene glycol, propylene glycol, hexylene glycol, and butylene glycol. Any variety of optical brighteners or fluorescent hitening agents can be included in the liquid detergents. In one embodiment, the liquid detergent includes at least two optical brighteners. Typical brighteners include stilbene, naphthalene, styrene and analogs thereof. When two or more brighteners are present they can be present at equal concentrations or up to at least a 2:1 weight ration between different brighteners or whitening agents. Polyacrylates can include a homopolymer or copolymer having a molecular weight ranging from about 500 to about 50,000. Polycarboxylates can be selected from the group citrate, oxidosuccinate, tartarate, hydroxycitrate, hydroxymalate, and succinate. Chelators can be any aminopolycarboxylate including ethylenediaminetetraacetic acid and nitrilotriacetic acid. Electrolytes can include NaCl and $Na_2SO_4$. Other detergent adjuncts or enhancers can be included. For example, the liquid detergent can include at least one detergent adjunct selected from the group consisting of dyes, fragrances, anti-redeposition agents, anti-foaming agents, buffers, and preservatives.

In another aspect, a phase stable liquid detergent can include 1) a nonionic surfactant at a concentration of at least 5% on a weight percentage basis; 2) an alkylamine ethoxylate at a concentration of at least 1% on a weight percentage basis; and 3) an anionic surfactant at a concentration of at least 25% on a weight percentage basis, wherein the anionic surfactant is neutralized by an alkylamine. In one embodiment, the alkylamine ethoxylate has at least about 5 moles of ethoxylate per mole of said alkylamine ethoxylate. In another embodiment, the nonionic surfactant has an HLB ranging from about 2 to about 16. Often, the liquid detergent will have a pour point less than about 40° C. Included in this embodiment are all of the surfactants that have been described for the other embodiments including any of the anionic, nonionic, and cationic surfactants including in particular, alkylbenzene and alkylether sulfates. Alkylamines used to neutralize these surfactants can be selected from triethanolamine, diethanolamine, diethylamine, 2-amino-methyl-1-propanol, and methylethylamine. The liquid detergent may have a viscosity ranging from about 500 cp to about 5000cp. These detergents may be able to be poured or pumped. To do so, some embodiments may have a pH ranges from about 6 to about 8. Included within these embodiments are embodiments containing a polyalkylene glycol having a molecular weight ranging from about 100 to about 5000.

The present invention relates to concentrated liquid detergents. Advantages of the invention include providing a stable, pourable concentrated aqueous detergent composition that exhibits enhanced washing performance. Concentrated liquid detergents can be formulated so that gelation and/or visual phase separation does not occur. The concentrated liquid detergents are effective for removing various types of soil, including sebum-related stains.

Unless otherwise defined, all technical and scientific terms and abbreviations used herein have the same meaning as commonly understood by one of ordinary skill in the art to which this invention pertains. Although methods and materials similar or equivalent to those described herein can be used in the practice or testing of the present invention, suitable methods and materials are described below. Other features and advantages of the invention will be apparent from the following description of the preferred embodiments and from the claims.

DETAILED DESCRIPTION

Concentrated and super-concentrated liquid detergents can be obtained by combining defined weight ratios of anionic surfactants, cationic surfactants, nonionic surfactants, alkylamines and polyalkylene glycols. Solvents, polyacrylates, polycarboxylic acids, chelators, brighteners, anti-redeposition polymers, builder compounds, electrolytes and other ingredients may be added to the liquid detergents. A concentrated liquid detergent contains surfactants at a concentration of at least 15% measured on a weight percentage basis. Super-concentrated liquid detergents can contain surfactants at a concentration of at least 30% measured on a weight percentage basis. Surfactant concentrations greater than about 40% and even as high as 98% may be possible. Concentrated and super concentrated liquid detergents incorporating aspects of the invention can produce a phase stable and pourable, or pumpable, liquid detergent composition having enhanced washing performance. Further, these detergents remain stable for an extended period of time. As used herein liquid detergents will refer to both concentrated and super-concentrated embodiments unless otherwise indicated.

Although other ingredients may be combined to manufacture liquid detergents as described and claimed herein, the following ingredients provide suitable examples for constructing liquid detergents.

Liquid detergents can contain an anionic surfactant at a concentration from about 5% to about 25% on a weight percentage basis. Anionic surfactants are known and can include alkylbenzene sulfonate surfactants and alkylether sulfate surfactants. Useful alkylbenzene sulfonate surfactants are represented by the following chemical formula:

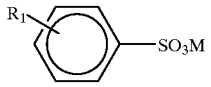

wherein $R_1$ is an alkyl group having from 1 to 15 carbon atoms and M is H, an alkali metal or an alkylamine. $R_1$ can be a straight or branched chain alkyl group and can be saturated or unsaturated. Suitable anionic surfactants include those described in U.S. Pat. No. 2,220,099 and U.S. Pat. No. 2,477,383. Such surfactants include the linear straight chain alkylbenzene sulfonates averaging about 9 to about 16 carbon atoms in the alkyl chain and generally abbreviated as "LAS" including but not limited decylbenzensulfonic acid, decylbenzensulfonate, dodecylbenzensulfonic acid, dodecylbenzensulfonate, tetradecylbenzensulfonic acid, tetradecylbenzensulfonate, undecylbenzensulfonic acid, undecylbenzensulfonate, nonylbenznesulfonic acid, nonylbenznesulfonate, hexdecylbenzensulfonic acid, and hexadecylbenzensulfonate. Suitable surfactants include the surfactants sold under the tradenames Biosoft S-100 available from Stapan, Calsoft LAS-99 available from Pilot, Phodacal LA Acid available from Rhone-Poulenc. Suitable alkali metals include sodium, potassium, and lithium. Suitable alkylamines include any short chain alkylamine, i.e., alkylamines wherein the carbon chain of the alkyl groups have no more than 6 carbon atoms. Useful alkylamines include monoethanolamine (MEA), 2-aminoethanol, 1-aminopropanol, 2-amino-methyl-1-propanol (AMP-95), 2-aminopropanol, triethylamine, triethanolamine (TEA), diethanolamine (DEA), diethylamine, triphenylamine, and mixtures thereof. The sulfonic group of the benzenesulfonic acid-based anionic surfactants should be neutralized by about 50% using alkylamine. In particular, the sulfonic group can be neutralized by about 50% to about 100% using alkylamine. An anionic surfactant is considered 50% neutralized when alkyl amine is present at a 1:2 mole ratio of alkylamine:surfactant at a pH of about 7 or higher. When the pH of the liquid detergent is less than about 7, an increased alkylamine concentration may be necessary to adequately neutralize the surfactant. The amount of alkylamine needed can be easily calculated using known methods. Any short chain alkylamine including mixtures of different alkylamines can be used to neutralize the benzenesulfonic acid-based anionic surfactants.

Suitable alkylether sulfate surfactants include any alcoholalkoxysulfate anionic surfactant. Useful alcoholalkoxysulfate surfactants are represented by the following chemical formula:

$$R_1—(OCHR_2CHR_2)_n—SO_4M$$

wherein $R_1$ is an alkyl group having from 10 to 22 carbon atoms, $R_2$ is H or an alkyl group having from 1 to 4 carbon atoms, n is an integer from about 1 to about 10, and M is H, an alkali metal, or alkylamine. $R_1$ can be a straight or branched chain alkyl group and can be saturated or unsaturated. $R_2$ can be a straight or branched chain alkyl group. It is to be understood that $R_2$ can vary within any one molecule of the alcoholalkoxysulfate surfactant such that the molecule can contain ethoxy, propoxy, butoxy groups, or a mixture thereof. Methods for manufacturing alkylether sulfates are known. Briefly, alkylether sulfate surfactants can be manufactured by condensing an alcohol with ethylene oxide followed by sulfonation and neutralization. Suitable alkylether sulfate surfactants include the surfactants sold under the tradenames Avirol and Stanpol 230-E available from Henkel, Geropan available form Rhone-Polanc, Calform available from Pilot, and Polystep and Steol available from Stapan.

Other anionic surfactants include alkyl glyceryl ether sulfates or alkyl glyceryl ether sulfonates, which are typically manufactured by condensing an alcohol with ethylene oxide followed by sulfation process and neutralization. Suitable surfactants include PEG (1–4) dodecylsulfate, (ammonium salt) PEG (12) decylsulfate (ammonium salt), PEG (9) dodecylsulfate (ammonium salt), PEG (12) dodecylsulfate, sodium salt, PEG (9) dodecylsulfate, sodium salt, PEG (1–4) dodecylsulfate, sodium salt, PEG (12) tetradecylsulfate, sodium salt, PEG (9) tetradecylsulfate, sodium salt, PEG (1–4) dodecylsulfate, sodium salt, PEG (12) dodecylsulfate, potassium salt, PEG (12) dodecylsulfate, magnesium salt, PEG (9) dodecylsulfate and sodium salt.

Liquid detergents can contain nonionic surfactants at a concentration from about 5% to about 65%, from about 10% to about 55%, or from about 10% to about 45% on a weight percentage basis. Suitable nonionic detergents have a pour point less than about 40° C., or less than about 35° C., or less than about room temperature, i.e., 25° C. The pour point is determined by cooling a surfactant below room temperature and then warming the surfactant to a set temperature, e.g., 25° C., 35° C., or 40° C. At the warmed temperature, the surfactant is tested to determine if it can be poured. Useful nonionic surfactants also have a hydrophile-lipophile balance (HLB) ranging from about 2 to about 20, or from about 4 to about 16, or from about 8 to about 14. Methods for computing the HLB are disclosed in Lin et al., *Israel J. of Technology,* 6:621–624 (1971), which is incorporated herein by reference in its entirety. Preferably, the nonionic surfactants are liquids.

Suitable nonionic surfactants include any linear or branched, or primary or secondary alcohol. The nonionic surfactants can be selected from the group of alkylphenylethers represented by the chemical formula:

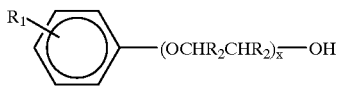

wherein $R_1$ is an alkyl group having from 6 to 16 carbon atoms, $R_2$ is H or an alkyl group having from 1 to 4 carbon atoms, and x is an integer from 1 to 10. $R_1$ can be a straight or branched chain alkyl group and can be saturated or unsaturated. $R_2$ can be a straight or branched chain alkyl group. It is to be understood that $R_2$ can vary within any one molecule of the alkylphenylether surfactant such that the molecule can contain from about 1 to about 10 molecules of ethoxy, propoxy, butoxy groups, or a mixture thereof. Other nonionic surfactants include alkylphenylethoxylates. They are typically manufactured by ethoxylation of alkylphenols. Suitable alkylphenylethoxylates include PEG-10 nonyl phenyl ether, PEG-8 nonyl phenyl ether, PEG-9 nonyl phenyl ether, PEG-16 nonyl phenyl ether, PEG-10 decyl phenyl ether, PEG-8 decyl phenyl ether, PEG-9 decyl phenyl ether, PEG-16 decyl phenyl ether, PEG-12 decyl phenyl ether, PEG-15 decyl phenyl ether and PEG-23 dodecyl phenyl ether. Suitable surfactants are sold under the tradenames nonylphenyl-10 EO (NP-10), Tergitol N-95, Surfonic OP, and Surfonic DDP available from Huntsman Petrochemical Corporation, Austin, Tex., and Tergitol NP-10 available from Union Carbide.

Suitable nonionic surfactants also include any alkylethoxylate, alkylpropoxylate, or alkylethoxylate propoxylate represented by the following chemical formula:

$$R_1—(OCHR_2CHR_2)_x—OR_3$$

wherein $R_1$ is an alkyl group containing from about 6 to about 22 carbon atoms, $R_2$ is H or an alkyl group having from 1 to 4 carbon atoms, and x is an integer from about 2 to about 20, and $R_3$ is H or an alkyl group having from 1 to 4 carbon atoms. $R_1$ can be a straight or branched chain alkyl group and can be saturated or unsaturated. $R_2$ can be a straight or branched chain alkyl group. It is to be understood that $R_2$ can vary within any one molecule of the alkylethoxylate-based nonionic surfactant such that the molecule can contain from about 2 to about 20 molecules of ethoxy, propoxy, butoxy groups, or a mixture thereof. It is to be understood that $R_3$ can vary within any one molecule of the alkylethoxylate-based nonionic surfactant such that the molecule can contain from about 2 to about 20 molecules of ethoxy, propoxy, butoxy groups, or a mixture thereof. These surfactants are typically manufactured by ethoxylation or propoxylation of long chain alcohols. Suitable nonionic surfactants include PEG-2 oleyl ether, PEG 10 oleyl ether, PEG-9 oleyl ether, PEG-15 oleyl ether, PEG-2 dodecyl ether, PEG-12 dodecyl ether, PEG-16 dodecyl ether, PPG-3 PEG4 decyl ether, and PPG-4 PEG-16 dodecyl ether. Acceptable surfactants include the surfactants sold under the tradename Neodol, including Neodol 25-9 (a $C_{12}$–$C_{15}$ alcohol with an average of 9 moles of ethylene oxide per mole of alcohol) available from the Shell Company and the surfactants sold under the tradename Alfonic 1218-70 available from Vista Chemical, Inc. can also be used.

If partially saturated nonionic surfactants are used, they can vary from about a $C_{10}$ to about a $C_{22}$ alkoxylated alcohol with a minimum iodine value of at least about 35. Suitable partially saturated nonionic surfactants are disclosed in U.S. Pat. No. 4,668,423, which is incorporated herein by reference in its entirety. An example of an ethoxylated propoxylated alcohol is Surfonic JL-80X available from Huntsman Petrochemical Corporation, Austin, Tex. Another suitable surfactant is Pluronic 25-5 from BASF Chemical Company.

The liquid detergents can include alkylamine ethoxylate surfactants represented by the chemical formula:

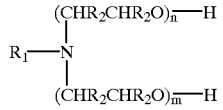

wherein $R_1$ is alkyl group having from about 6 to about 22 carbon atoms, $R_2$ is H or an alkyl group having from 1 to 4 carbon atoms, and m and n are an integers ranging from about 1 to about 20, preferably from about 2 to about 10. $R_1$ can be a straight or branched chain alkyl group and can be saturated or unsaturated. $R_2$ can be a straight or branched chain alkyl group. It is to be understood that $R_2$ can vary within any one molecule of the alkylamineethoxylate surfactant such that the molecule can contain from about 2 to about 20 molecules of ethoxy, propoxy, butoxy groups, or a mixture thereof. Suitable Alkylamine ethoxylates include PEG-15 hexadecyl amine, PEG-30 oleamine, PEG-12 oleamine, PEG-30 oleamine, PEG-20 tallowamine, PEG-12 dodecylamine, PEG-16 laurylamine and PEG-30 hexadecylamine. Suitable surfactants include the surfactants sold under the tradenames Tomah-E-T-10 and Tomah-E-T-15 available from Tomah, Rhodameen S-20 and Rhodameen S-25 available from Rhone-poulanc, Surfonic T-15 available from Huntsman Petrochemical Corporation, Austin, Tex., Rymeen TAM-15 available from Henkel, and Varonic T-215 available from Witco.

The liquid detergent may contain a polyalkylene glycol, e.g., polyethylene glycol, at a concentration from about 1% to about 15% on a weight percentage basis. The glycol may also be present at a concentration from about 2% to about 10% on a weight percentage basis. The glycol may stabilize the detergent and may or may not enhance cleaning performance. The polyalkylene glycol molecular weight can range from about 100 to about 50,000. Preferably, the molecular weight ranges from about 100 to about 5,000. Useful polyalkylene glycols are represented by the chemical formula:

$$H—(OCHR_1CHR_1)_x—OH$$

wherein $R_1$ is H or an alkyl group having from about 1 to about 4 carbon atoms, and x is an integer ranging from about 2 to about 100, preferably from about 2 to about 15. $R_1$ can be a straight or branched chain alkyl group. $R_1$ can be a straight or branched chain alkyl group. It is to be understood that $R_1$ can vary within any one molecule of the alcoholalkoxysulfate surfactant such that the molecule can contain ethoxy, propoxy, butoxy groups, or a mixture thereof. Suitable low molecular weight polyethylene glycols include block copolymers of ethyleneoxide and propylenoxide-500, Polyethylenglycol-300, Polyethylenglyco-500 and Polyethyleneglycol-200.

Lower alkanols, i.e., alcohols having from about 1 to about 6 carbons can be added to the liquid detergent to enhance dispersability and rinsability, and alter the viscosity of the detergent. The lower alkanols are useful when added at concentrations up to about 15% on a weight percentage basis. Typically, the concentration of the lower alkanols will range from about 0.1% to about 7%. Useful lower alkanols include ethanol, propanol, propylene glycol, hexylene glycol and other alkylene glycols. A preferred lower alkanol is propylene glycol. Additional compounds thought to functions as stabilizers include sodium xylene sulfonate, NaCl or $NaSO_4$, which can be added at concentrations up to about 5%, or up to about 10%, on a weight percentage basis.

Additional ingredients can enhance detergent performance under hard water conditions. Suitable detergent enhancers include polyacrylate and polymethacrylate polymers added at concentrations from about 0.1% to about 10%, in particular from about 0.1% to about 5%. The acrylate polymers can be homopolymers or copolymers. Acrylate copolymers are polymerized with compounds such as maleic acid (maleic anhydride), allylic alcohol and other alkylacrylate polymers. The acrylate-based polymers are generally soluble in water, and can be neutralized with alkali metals or alkylamines. Additional enhancers include water soluble chelators added to the liquid detergents at concentrations ranging from about 0.1% to about 10% or from about 0.1% to about 5%. Suitable chelators may contain a carboxylate functional group including any aminopolycarboxylate, e.g., ethylenediaminetetraacetic acid (EDTA), nitrilotriacetic acid (NTA), oxidosuccinate, and citrate. Organic polycarboxylic acids present at concentrations ranging from about 0.01% to about 5% on a weight percentage basis will function as builders for the liquid detergents. Suitable organic polycarboxylates include citrate, oxidosuccinate, tartarate, hydroxycitrate, hydroxymalate and succinate.

Optical brighteners or fluorescent whitening agents (FWA) are known and can be added to the liquid detergents at a concentration ranging from about 0.25% to about 2%, preferably from about 0.25% to about 1%. Adding two or more FWA's can improve the appearance of articles or fabrics that have undergone repeated washings. When two or more FWA's are used, the FWA's can be added at weight ratios ranging from about 1:1 to about a 2:1. Examples of suitable FWA's are disclosed in U.S. Pat. Nos. 3,951,960, 3,980,713, 3,993,659 and 4,298,290, which are incorporated herein by reference in their entirety. Useful FWA's include stilbene, styrene, and naphthalene derivatives. Commercially available FWA's include the FWA's sold under the tradenames Tinopal CBS-X and Tinopal 5MBX both available from Ciba Geigy AG, Phowhite BBH available from Bayer Chemicals, and Optiblanc 2M/G available from 3V, Georgetown, S.C.

Other additional compounds, such as dyes, fragrances, anti-redeposition agents, and preservatives, processing aids, fillers, bleaches and the like that are commonly included in liquid detergents can be added to the liquid detergents described herein. Useful dyes include monastral blue and anthraquinone dyes as disclosed in U.S. Pat. No. 4,746,461, which is hereby incorporated by reference in its entirety. Anti-redeposition agents include the compounds sold under the tradename HP-22 available from BASF, and carboxymethylcellulose available from Pencarbose, Pittsburgh, Pa. Dyes, anti-redeposition compounds, and preservatives are usually added at concentrations ranging from about 0.1% to about 5%, preferably from about 0.1% to about 2.5%. Fragrances are usually present at concentrations ranging from about 0.1% to about 1%. The fragrance concentration can affect the stability of the detergent and a lower concentration is therefore preferred. These additional compounds should be added in effective amounts, i.e., "q.s.".

The pH of the liquid detergents is maintained between about 6 and about 9, preferably between about 7 and about 8. Any acid or base can be used to adjust the pH and buffer the liquid detergent. Useful acids and bases for adjusting the pH and buffering liquid detergents include citric acid, maleic acid, alkylamines (e.g., AMP-95), triethanolamine, diethanolamine, and methylethylamine. Citric acid functions as a useful pH adjusting compound and as a detergent builder.

The detergent viscosity should range from about 300 centipoise (cp) to about 5000 cp, preferably, from about 500 cp to about 2000 cp when measured at ambient temperature, i.e., room temperature. Typically, liquid detergents can be poured when the viscosity is no greater than about 10,000 and can be pumped when the viscosity is less than about 5,000 at ambient temperature.

Methods for manufacturing and storing liquid detergents, in general, are known. The order of adding the requisite components for the detergents described herein can be important. The following is a suitable method for mixing a liquid detergent. The surfactants are premixed at the appropriate concentrations in a mixer. Any mixer can be used, for example, useful mixers such as mixer model R2R80 are available from Heidolph Corporation, USA. The appropriate concentration of a low molecular weight polyalkylene glycol is added to the surfactant pre-mixture. Alkylamine is then slowly added to the pre-mixture. During the addition of the alkylamine, small samples of the pre-mixture are removed and diluted in water to produce a 10% solution. The pH of the 10% solution is measured. Alkylamine addition continues until the pH of the sample 10% solution is between about 7 and about 9. Water is then added to the surfactant pre-mixture to bring the water to a final weight concentration of at least about 20%. Such initial steps have been found to prevent salting out of the surfactant pre-mixture during long-term storage.

Chelators and water are added to a clean mixer. The pH of the chelator solution is adjusted to about 9 with alkylamine or NaOH. A first FWA is added to the pH adjusted chelator solution. The surfactant pre-mixture is then added to the chelator solution. The pH is re-adjusted to about 9. The second FWA is added. At this time, any additional FWA's can be added to the detergent mixture as long as each FWA is mixed into the detergent mixture separately. Appropriate amounts of redeposition polymers, fragrances, preservatives and NaCl are added. Citric acid is added to adjust the final pH, which ranges from about 7 to about 8.5. Color dyes and low molecular weight polyacrylate solutions are added to complete the liquid detergent. Finally, water is added to bring the liquid detergent to its final volume.

The stability of the liquid detergent can be determined by cycling the liquid detergent through freeze-thaw cycles. The liquid detergent is cooled to a temperature below 0° C. until the entire mixture is frozen, typically overnight, and then placed at room temperature and allowed to thaw. The detergent is then visually inspected for signs of phase separation and/or gelation. Additionally, the stability is measured by heating the detergent to 40° C. for about two weeks and again visually inspecting the detergent for phase separation and/or gelation. Further evaluations can include centrifuging a sample of the detergent from about 5,000 to about 10,000 r.p.m. for 5 to 10 minutes. A stable detergent has only one phase. Visual observation of multiple phases indicates that the detergent is unstable.

The cleaning ability of the liquid detergents is evaluated using fabric swatches in actual washing machines. Fabric swatches that are approximately 3–4 inches are soiled with scientific services used motor oil, coffee, standard oil, dust, sebum, and or ground-in clay. The soiled swatches are washed in commercial available washing machines under a variety of settings to evaluate the cleaning ability of the liquid detergents. The cleaning ability is measured using known methods using a reflectometer.

The invention may be illustrated by way of the following examples.

EXAMPLE 1

A Stable Liquid Detergent

Surfactants LAS, Surfonic T-15, and Surfonic L-24-7 were added to a mixer and mixed. Polyethylene glycol (MW 300) was mixed with the surfactants. Methylethylamine was slowly added to the surfactant pre-mixture until a sample 10% solution had a pH of about 9. Water was added to the pre-mixture such that the water attained a 20% weight fraction. Water and EDTA were added to a clean mixer and the pH was adjusted to about 9 using methylethylamine. Tinapol 5MBX was added to the EDTA solution. The surfactant pre-mixture was added to the EDTA solution. The pH was adjusted to about 9 using triethanolamine. Optiblanc 2M/G was added to the mixture. Fragrance, anti-redeposition compound HP-22, preservatives, and NaCl were added to the mixture. The pH was adjusted to about 8 using citric acid. The dye and polyacrylate was added to the mixture. Water was added to bring the detergent to a final volume. The detergent was a liquid at room temperature and did not separate under any of the stability tests. The liquid detergent had the following weight percentage composition.

| Constituent | Weight % Composition |
|---|---|
| Water | Balance |
| EDTA | 1.000 |
| Tinapol 5MBX | 0.25 |
| LAS | 12 |
| Surfonic T-15 | 12 |
| Surfonic L-24-7 | 22 |
| MEA | 2.5 |
| Polyethyleneglycol-300 | 2.5 |
| Triethanolamine | 0.5 |
| Optiblanc 2M/G | 0.25 |
| BASF HP-22 | 2.5 |
| Dye | q.s. |
| Fragrance | q.s. |
| Preservative | q.s. |
| Sodium Chloride | 0.25 |
| Citric Acid | 0.3 |
| Polyacrylate | 1.0 |

EXAMPLE 2

A Stable Liquid Detergent

A stable liquid detergent having the weight percentage composition indicated below was constructed using the method of Example 1.

| Consituent | Weight % Composition |
|---|---|
| Water | Balance |
| EDTA | 1.5 |
| Tinapol 5MBX | 0.3 |
| LAS | 10 |
| Tergitol NP-10 | 15 |
| Surfonic T-15 | 22 |
| MEA | 2.5 |
| Polyethyleneglycol-500 | 2.5 |
| Triethanolamine | 0.5 |
| Optiblanc 2M/G | 0.3 |

-continued

| Consituent | Weight % Composition |
|---|---|
| BASF HP-22 | 4.0 |
| Dye | q.s. |
| Fragrance | q.s. |
| Preservative | q.s. |
| Sodium Chloride | 0.3 |
| Citric Acid | 1.0 |
| Polyacrylate | 1.0 |

EXAMPLE 3

A Stable Liquid Detergent

A stable liquid detergent having the weight percentage composition indicated below was constructed using the method of Example 1.

| Constituent | Weight % Composition |
|---|---|
| Water | Balance |
| EDTA | 1.0 |
| Tinapol 5MBX | 0.3 |
| AEOS | 12.0 |
| Surfonic T-15 | 13.0 |
| Neodol-25-9 | 24.0 |
| MEA | 2.5 |
| Polyethyleneglycol-300 | 2.5 |
| Triethanolamine | 0.5 |
| Optiblanc 2M/G | 0.3 |
| BASF HP-22 | 2.5 |
| Dye | q.s. |
| Fragrance | q.s. |
| Preservative | q.s. |
| Sodium Chloride | 1.3 |
| Citric Acid | 0.3 |
| Polyacrylate | 1.0 |

EXAMPLE 4

A Stable Liquid Detergent

A stable liquid detergent having the weight percentage composition indicated below was constructed using the method of Example 1.

| Constituent | Weight % Composition |
|---|---|
| Water | Balance |
| EDTA | 0.5 |
| Tinapol 5MBX | 0.25 |
| LAS | 10.7 |
| Surfonic T-15 | 10.7 |
| Surfonic L-24-7 | 21.4 |
| MEA | 2.4 |
| Polgol 300 | 2.4 |
| Optiblanc 2M/G | 0.25 |
| HP-22 | 2.5 |
| Dye | q.s. |
| Fragrance | q.s. |
| Preservative | 0.1 |
| NaCl | 0.25 |
| Citric Acid | 0.250 |
| Polyacrylate | 0.25 |

EXAMPLE 5

Effect of Alkylamine Ethoxylate and Alkylamine on Liquid Detergent Phase Stability Five (A-E) liquid detergents having the ingredients at the indicated weight percentage concentrations detailed below were constructed according to the method of Example 1. The detergents were held at 40° C. for two weeks and then subjected to centrifugation at 10,000 r.p.m. for 10 minutes. The liquid detergents were visually inspected for multiple phases. The presence of more than one phase resulted in the detergent being labeled as unstable. The presence of a single phase resulted in the detergent being labeled as stable.

| Ingredients | A | B | C | D | E |
|---|---|---|---|---|---|
| Tergitol NP-10 | 21.4 | 21.4 | 0 | 21.4 | 0 |
| Surfonic T-15 | 10.7 | 10.7 | 10.7 | 10.7 | 12 |
| LAS | 10.7 | 10.7 | 10.7 | 10.7 | 12 |
| Pgol 300 | 7.2 | 0 | 0 | 0 | 8 |
| MEA | 2.4 | 0 | 0 | 0 | 2.8 |
| 50% NaOH | 0 | 1.3 | 1.3 | 1.3 | 0 |
| Surfonic JL80X | 0 | 0 | 21.4 | 0 | 23 |
| Optical brightener | 0.5 | 0.5 | 0.5 | 0.5 | 0.5 |
| HP-22 | 2.5 | 2.5 | 2.5 | 2.5 | 2.5 |
| Dye | q.s | q.s | q.s | q.s | q.s |
| Fragrance | q.s. | q.s | q.s | q.s | q.s |
| Preservative | q.s. | q.s | q.s | q.s | q.s |
| NaCl | 0.25 | 0.25 | 0.25 | 0.25 | 0.25 |
| Citric acid | 0.25 | 0.25 | 0.25 | 0.25 | 0.25 |
| Polyacrylate | 0.250 | 0.25 | 0.25 | 0.25 | 0.25 |
| Water | Balance | Balance | Balance | Balance | Balance |
| Stable | Yes | No | No | No | Yes |

EXAMPLE 6

Cleaning Ability

The cleaning ability of the liquid detergent of Example 2 was compared to commercially available liquid detergents using a conventional cleaning evaluation method that is well-known to those of ordinary skill in the art. The evaluation measures stain and soil removal effectiveness. The method is summarized as follows:

Fifteen 100% cotton and 50:50 polyester:cotton cloth swatches approximately 3 inches by 4 inches in size were pre-stained with commercially available stains and soils. The swatches were obtained from Scientific Services Corporation. The stains and soils used were: 1) used motor oil (DMO), 2) Coffee, 3) standard soil, 4) dust/sebum, 5) ground-in clay.

Laundering conditions for each test were the same. The stained swatches were attached to 100% cotton towels and each load was adjusted with towels to bring the wash load to 4 pounds. No bleach was added. Test loads were washed in a Kenmore Heavy Duty 70 Series (TM) washing machines filled with 88 L of water at 40° C. Water hardness was set at 260 ppm with $Mg^{++}$ and $Ca^{++}$ salts. Each load received ¼ cup of detergent. After washing, the cloths were tumble dried in an electric dryer and were not ironed.

Three reflectance (R) measurements were performed on each cloth swatch before and after washing the cloth swatches. The measurements were averaged. Each reading was taken at the same positions as the initial reflectance measurements. The percent stain or so, removal for each stain and cloth swatch was calculated using Equation 1.

$$\%\ Soil\ Removal = \left(\frac{R_{(after)} - R_{(before)}}{R_{(before)}}\right) * 100 \qquad \text{Equation 1}$$

The result of this formula compared to the leading brands is as follows. The test was blinded to minimize discrepancy. The average percent stain or soil removal for each cloth is compared in Table 1. The liquid detergent of Example 2 was shown to be significantly better at removing dust/sebum soil types from the tested cloth swatches.

The detergents had the following ingredients:

| | Brand A | Brand B | Example 2 detergent |
|---|---|---|---|
| Anionic | | | |
| (LAS) | — | 6% | 8.8% |
| (AES) | 18% | 1.5% | — |
| Alkylamine Ethoxylate | — | — | 8.8% |
| Nonionic | 6% | 8% | 17.4% |
| MEA | — | — | 1.2% |
| Polyethylene glycol | — | — | 6% |
| Propylene glycol | 7% | ~5% | — |
| Ethanol | 3.4% | qs | — |
| Builder | 3% | ~2.5% | 1.5% |

TABLE 1

PERFORMANCE EVALUATION

| | BRAND A % Stain removal | | BRAND B % Stain removal | | Example 2 L. Det. % Stain removal | |
|---|---|---|---|---|---|---|
| Soil/Stain | Cot. | Poly/ Cotton | Cot. | Poly/ Cot. | Cot. | Poly/ Cot. |
| USED MOTOR OIL | 26.4 | — | 28.7 | — | 29.2 | — |
| COFFEE | — | 54.3 | — | 58.4 | — | 58.2 |
| STANDARD SOIL | 12.4 | — | 11.8 | — | 11.9 | — |
| DUST/SEBUM | 24.3 | 31.3 | 19.2 | 25.3 | 30.6 | 32.4 |
| GROUND-IN CLAY | 30.9 | 67.5 | 36.4 | 66.4 | 32.3 | 67.7 |
| WHITENESS RETENTION, PERCENTAGE | 99.4 | | 99.8 | | 101 | |
| WATER HARDNESS, PPM | 260 | | 260 | | 260 | |
| VISCOSITY | 253.00 | | 243.00 | | 788.00 | |
| PERCENT SOLIDS | 27% | | 26% | | 40% | |

EXAMPLE 7

Washing evaluations were performed as in Example 6. In this evaluation, washings were performed in a Kenmore Heavy Duty 80 Series (™) washer using the hot/cold water settings and heavy duty cycle for 10 minutes. Each wash cycle received ¼ cup dosage (0.89 g/liter) of detergent. Water hardness was adjusted to 300 ppm using $CaCl_2$ and $MgCl_2$, which was premixed at a 2:1 weight ratio, respectively. The soiled swatches were attached to cotton towels and washed in triplicate along in 4 pound wash loads. Both standard soils and stains were run to give a measure of performance over a wide range of soil type. Washing evaluations were performed as indicated in Example 6. The results are shown in Table 2.

TABLE 2

| Grass, Dust, Sebum, Olive Oil removal. | | | | | | | | |
|---|---|---|---|---|---|---|---|---|
| | BRAND A ⅛ CUP | | GENERIC A ⅛ CUP | | GENERIC B ¼ CUP | | Example 2 ⅛ CUP | |
| Soil/ Stain | Cot. | Poly/ Cot. | Cot. | Poly/ Cot. | Cot. | Poly/ Cot. | Cot. | Poly/ Cot. |
| GRASS STAIN | 3.00 | 4.25 | 2.75 | 5.00 | 2.50 | 5.00 | 3.25 | 6.50 |
| DUST SEBUM | 6.00 | 9.00 | 6.00 | 11.00 | 10.0 | 12.00 | 12.00 | 24.00 |
| OLIVE OIL | 3.50 | 5.00 | 5.50 | 6.50 | 6.00 | 6.50 | 5.50 | 6.50 |

EXAMPLE 8

Enhanced Effect of Two Optical Brighteners

Liquid detergents as indicated in Example 2 were prepared having optical brighteners at 0.15% or 0.3% weight percentage as indicated in Table 3. Clean cloth swatches were washed as described in Example 6. The water hardness was adjusted to 300 ppm. The wash temperature was 40° C. The optical brighteners were added individually or in combination to the detergent. The whiteness index was computed using well-known methods.

TABLE 3

| Whiteness Retention | | | | | | |
|---|---|---|---|---|---|---|
| | 0.15% Optical brighteners Tinapol 5 MBX & Optiblanc 2M/G | | 0.3% Optical Brightener Optiblanc 2M/G | | 0.15% Optical Brightener Optiblanc 2M/G | |
| | Cot. | Poly/Cot. | Cot. | Poly/Cot. | Cot. | Poly/Cot. |
| Whiteness Index | 79 | 81 | 76 | 81 | 75 | 81 |

EXAMPLE 9

Unstable Formulas

In an effort to derive concentrated and super-concentrated liquid detergents various formulations were tried. The formulas were unsuccessful as indicated in Table 4. This example demonstrates that the simple mixing of ingredients will not necessarily lead to the advantages of the present invention.

TABLE 4

| Unsuccessful Formulas. | | | |
|---|---|---|---|
| | Unstable Formula #1 | Unstable Formula #2 | Unstable Formula #3 |
| Ingredients | | | |
| Water | 45.6 | 40.5 | 44.6 |
| Propylene Glycol | 5.00 | 5.00 | 5.00 |
| LP | 0.5 | 0.5 | 0.5 |
| DP | 0.5 | 0.5 | 0.5 |
| Sodium Citrate | 3.0 | 3.0 | 3.0 |

TABLE 4-continued

| Unsuccessful Formulas. | | | |
|---|---|---|---|
| Sodium Xylene Sulfonate | 5.0 | 5.0 | 5.0 |
| HP-22 | 0.4 | 0.4 | 0.4 |
| Biosoft S-100 | 10.0 | 11.3 | 7.0 |
| Nonionic blend 60/40 (Nonoxynol 10/Surfonic JL80X) | 30.00 | 33.8 | 33.0 |
| | Sodium Hydroxide 50% and TEA to adjust the pH to 8.0–8.5 | Sodium Hydroxide 50% and TEA to adjust the pH to 8.0–8.5 | Sodium Hydroxide 50% and TEA to adjust the pH to 8.0–8.5 |
| Qualities | | | |
| Viscosity | 302.5 cps | 357.5 cps | 320 cps |
| pH | 8.15 | 8.11 | 8.15 |
| Centrifuge | 3 layers | 3 layers | 3 layers |
| Freeze/Thaw | 2 layers | 2 layers | 2 layers |

| Unstable Formula #4 | | Unstable Formula #5 | |
|---|---|---|---|
| Ingredient | | Ingredient | |
| Water | 57.919 | Water | 40.15 |
| Sodium Chloride | 0.00 | Polgol 300 | 5.00 |
| Sodium Citrate | 5.00 | LP | 0.75 |
| Nonoxynol 10 | 14.00 | DP | 0.5 |
| Dodecylbenzene Sulfonic Acid | 8.00 | Sodium Citrate | 3.0 |
| Surfonic JL-80X | 12.00 | Sodium Xylene Sulfonate | 5.0 |
| Tinopal UNPA | 0.00 | HP-22 | 0.5 |
| TEA | 0.00 | Biosoft S-100 | 7.0 |
| LP | 1.00 | Nonionic Blend 60/40 (Nonoxynol 10/Surfonic JL80X) | 33.8 |
| DP | 1.00 | Sodium Hydroxide 50% and TEA to adjust the pH to 8.0–8.5 | |
| HP-22 | 0.5 | | |
| Plurafac B-25-2 | 0.5 | | |
| Melaleuca Oil | 0.5 | | |
| Fragrance | 0.00 | | |
| Kanthon ICP | 0.08 | | |
| Qualities | | Qualities | |
| Viscosity | 255 cps | Viscosity | 262.5 cps |
| pH | 8.0 | PH | 8.13 |
| Centrifuge | 2 layers | Centrifuge | 3 layers |
| Freeze/Thaw | | Freeze/Thaw | |

LP = Burcosperse LP & DP = Burcosperse DP each available from Burlington Chemicals.

Other embodiments of the invention are within the scope of the following claims.

What is claimed is:

1. A liquid detergent comprising:

a) an anionic surfactant at a concentration from about 5% to about 55% on a weight percentage basis;

b) a nonionic surfactant at a concentration from about 10% to about 55% on a weight percentage basis;

c) an alkylamine ethoxylate surfactant at a concentration from about 5% to about 55% on a weight percentage;

d) a polyalkylene glycol at a concentration from about 1% to about 25% on a weight percentage basis, wherein said polyalkylene glycol has a molecular weight ranging from about 100 to about 5000; and e) an alkylamine in an amount effective to adjust the pH of the liquid detergent from about 6 to 9, wherein said liquid detergent is phase stable so that gelation and/or visual phase separation does not occur, has a pH ranging from about 6 to about 9, and comprises surfactants at a concentration of at least 30% on a weight percentage basis.

2. The detergent of claim 1, wherein said alkylamine ethoxylate surfactant comprises at least about 5 moles of ethoxylate per mole of said alkylamine ethoxylate.

3. The detergent of claim 1 wherein said alkylamine is selected from the group consisting of monoethanolamine, triethanolamine, and diethanolamine.

4. The detergent of claim 1, wherein said anionic surfactant comprises an alkylbenzene sulfonate having the formula

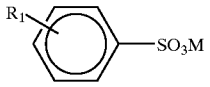

wherein $R_1$ is an alkyl group having from 1 to 15 carbon atoms, and wherein M is H, alkali metal, or alkylamine.

5. The detergent of claim 4 wherein said $R_1$ is a linear alkyl group having from about 8 carbons to about 16 carbons.

6. The detergent of claim 4, wherein said M is said alkali metal, and wherein said alkali metal is selected from the group consisting of sodium, potassium, and lithium.

7. The detergent of claim 1, wherein said anionic surfactant comprises an alkylether sulfate having the formula:

$$R_1—(OCHR_2CHR_2)_n—SO_4M$$

wherein $R_1$ is an alkyl group having from 10 to 22 carbon atoms, wherein $R_2$ is H or an alkyl group having from 1 to 4 carbon atoms, wherein n is an integer from 1 to 10, and wherein M is an alkali metal or an alkylamine.

8. The detergent of claim 7, wherein said alkylether sulfate is $C_{10}$–$C_{18}$ alcohol sulfate with 1 to 7 moles of ethyleneoxide per mole of alcohol.

9. The detergent of claim 8 wherein said 50% of said alkylether sulfate is neutralized with alkylamine.

10. The detergent of claim 9 wherein said alkylamine is selected from the group consisting of monoethanolamine, triethanolamine, and diethanolamine.

11. The detergent of claim 1 wherein said nonionic surfactant comprises an alkoxylated alcohol having the formula $$R_1—(OCHR_2CHR_2)_x—OR_3$$

wherein $R_1$ is an alkyl group having from 6 to 22 carbon atoms, $R_2$ is H or an alkyl group having from 1 to 4 carbon atoms, x is integer from 2 to 20, and $R_3$ is H or an alkyl group having from 1 to 4 carbon atoms.

12. The detergent of claim 11, wherein said alkoxylated alcohol contains from 2 to 20 moles of ethoxylate, propoxylate, or a mixture thereof.

13. The detergent of claim 12 wherein said alkoxylated alcohol comprises an ethoxylated alcohol having from 8 to 16 carbon atoms, and wherein said alkoxylated alcohol further comprises from about 4 to about 20 moles of ethylene oxide per mole of said alkoxylated alcohol and less than 4 moles of propylene oxide per mole of said alkoxylated alcohol.

14. The detergent of claim 1 wherein said nonionic surfactant comprises alkylphenyl ethoxylate having the formula

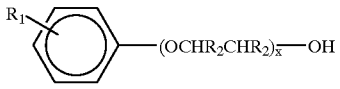

wherein $R_1$ is an alkyl group having from 6 to 16 carbon atoms, $R_2$ is H or an alkyl group having from 1 to 4 carbon atoms, and x is an integer from 1 to 10.

15. The detergent of claim 14, wherein said alkylphenyl ethoxylate contains from 1 to 10 moles of ethoxylate, propoxylate, or a mixture thereof.

16. The detergent of claim 14, wherein said alkylphenyl ethoxylate comprises an ethoxylated $C_6$ to $C_{16}$ phenylalcohol further comprising from about 4 to about 20 moles of ethylene oxide per mole of said alkylphenyl ethoxylate and less than 4 moles of propylene oxide per mole of said alkylphenyl ethoxylate.

17. The detergent of claim 11, wherein said alkoxylated alcohol comprises an ethoxylated $C_8$ to $C_{16}$ alcohol having from about 4 to about 20 moles of ethylene oxide per mole of alcohol and less than 4 moles of propylene oxide per mole of alcohol.

18. The detergent of claim 11, wherein said alkoxylated alcohol comprises an ethoxylated $C_8$ to $C_{16}$ alcohol having from about 4 to about 20 moles of ethylene oxide per mole of alkoxylated alcohol and less than 4 moles of propylene oxide per mole of alkoxylated alcohol.

19. The detergent of claim 1, wherein said alkylamine ethoxylate surfactant has the formula

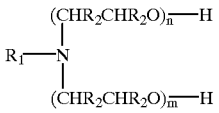

wherein $R_1$ is alkyl group having from 6 to 22 carbon atoms, $R_2$ is H or an alkyl group having from 1 to 4 carbon atoms, and m and n are integers ranging from about 1 to about 20.

20. The detergent of claim 19, wherein said alkylamine ethoxylate surfactant comprises an ethoxylated $C_8$ to $C_{16}$ amine having from about 4 to about 26 moles of ethylene oxide per mole of said alkylamine ethoxylate surfactant and less than 4 moles of propylene oxide per mole of said alkylamine ethoxylate surfactant.

21. The detergent of claim 1 wherein said polyalkylene glycol is selected from the group consisting of polyethylene glycol and polypropylene glycol.

22. The detergent of claim 1, wherein said polyalkylene glycol comprises a polyethylene glycol or a polyethyleneepropylene glycol having a molecular weight ranging from about 100 to about 5000.

23. The detergent of claim 1 wherein said polyalkylene glycol is derived from a mixture of ethyleneoxide and propyleneoxide.

24. The detergent of claim 1 wherein said polyalkylene glycol has the formula $$H—(OCHR_1CHR_1)_x—OH$$

wherein $R_1$ is H or an alkyl group having from 1 to 4 carbon atoms, and x is ant integer ranging from about 2 to about 100.

25. The detergent of claim 1 further comprising:

a) an optical brightener at a concentration from about 0.01% to about 1% on a weight percentage basis;

b) a polyacrylate having a molecular weight ranging from about 500 to about 50000, said polyacrylate at a concentration from about 0.01% to about 2% on a weight percentage basis;

c) an organic polycarboxylic acid at a concentration from about 0.01% to about 5% on a weight percentage basis;

d) a chelator at a concentration from about 0.01% to about 5% on a weight percentage basis; and e) an electrolyte at a concentration from about 0.01% to about 5% on a weight percentage basis.

26. The detergent of claim 25, said detergent further comprising a solvent at a concentration no greater than about 15% on a weight percentage basis, said solvent comprising a lower alkanol, glycol, or alkylene.

27. The detergent of claim 25, wherein said detergent comprises at least one solvent selected from the group consisting of propanol, ethanol, isopropanol, ethylene glycol, propylene glycol, hexylene glycol, and butylene glycol.

28. The detergent of claim 25 wherein said brightener comprises at least two optical brighteners.

29. The detergent of claim 28, wherein said brightener is selected from the group consisting of stilbene, naphthalene, styrene, and analogs thereof.

30. The detergent of claim 28, wherein said at least two optical brighteners are present at an equal weight ratio.

31. The detergent of claim 28, wherein said at least two optical brighteners are present at a weight ratio ranging from about 1:1 to about 2:1.

32. The detergent of claim 28, wherein said detergent comprises no more than two optical brighteners, said optical brighteners added to said detergent at a weight ratio of 2:1.

33. The detergent of claim 25 wherein said polyacrylate comprises a homopolymer or copolymer having a molecular weight ranging from about 500 to about 50,000.

34. The detergent of claim 25, wherein said polycarboxylate is selected from the group consisting of citrate, oxidosuccinate, tartarate, hydroxycitrate, hydroxymalate, and succinate.

35. The detergent of claim 25 wherein said polycarboxylic acid is citrate.

36. The detergent of claim 25 wherein said chelator comprises an aminopolycarboxylate.

37. The detergent of claim 25 wherein said chelator is selected from the group consisting of ethylenediaminetetraacetic acid and nitrilotriacetic acid.

38. The detergent of claim 25 wherein said electrolyte is selected from the group consisting of NaCl and $Na_2SO_4$.

39. The detergent of claim 25 further comprising at least one detergent adjunct selected from the group consisting of dyes, fragrances, anti-redeposition agents, anti-foaming agents, buffers, and preservatives.

40. The detergent of claim 4, wherein said M is said alkylamine, and wherein said alkylamine is selected from the group consisting of monoethanolamine, triethanolamine, and diethanolamine.

* * * * *

UNITED STATES PATENT AND TRADEMARK OFFICE

CERTIFICATE OF CORRECTION

PATENT NO. : 6,376,446 B1 
DATED : April 23, 2002
INVENTOR(S) : Suk H. Cho, George A. Smith and Raeda Smadi It is certified that error appears in the above-identified patent and that said Letters Patent is hereby corrected as shown below:

Column 18,
Line 53, please delete “ant” and insert -- an -- therefor.

Signed and Sealed this

Eighteenth Day of February, 2003

JAMES E. ROGAN
*Director of the United States Patent and Trademark Office*